US008903295B2

(12) United States Patent
Naito et al.

(10) Patent No.: US 8,903,295 B2
(45) Date of Patent: Dec. 2, 2014

(54) INDUCTION HEATED FIXING DEVICE AND IMAGE FORMING APPARATUS

(71) Applicant: Fuji Xerox Co., Ltd., Tokyo (JP)

(72) Inventors: Yasutaka Naito, Kanagawa (JP); Shigehiko Haseba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 31 days.

(21) Appl. No.: 13/762,610

(22) Filed: Feb. 8, 2013

(65) Prior Publication Data

US 2014/0072352 A1 Mar. 13, 2014

(30) Foreign Application Priority Data

Sep. 13, 2012 (JP) ..... 2012-201896

(51) Int. Cl.
*G03G 15/20* (2006.01)

(52) U.S. Cl.
CPC ..... *G03G 15/2039* (2013.01); *G03G 15/2053* (2013.01); *G03G 2215/2035* (2013.01)
USPC ..... 399/329

(58) Field of Classification Search
CPC ..... G03G 15/2039; G03G 15/20; G03G 2215/2025; G03G 15/2053
USPC ..... 399/67, 69, 329; 219/216, 619, 645
See application file for complete search history.

(56) References Cited

U.S. PATENT DOCUMENTS

2009/0232534 A1 9/2009 Haseba et al.
2010/0215390 A1* 8/2010 Tomita et al. ..... 399/69

FOREIGN PATENT DOCUMENTS

JP 2009-223044 A 10/2009

* cited by examiner

*Primary Examiner* — David Gray
*Assistant Examiner* — Travis Harper
(74) *Attorney, Agent, or Firm* — Sughrue Mion, PLLC

(57) ABSTRACT

A fixing device includes a fixing member that fixes toner on a recording material; a magnetic-field-producing unit including an exciting member that produces an alternating-current magnetic field, and first magnetic-circuit-producing members that each produce a magnetic circuit of the alternating-current magnetic field and are provided at a predetermined first interval and a second interval, smaller than the first interval, in a longitudinal direction of the fixing member; a temperature measuring device that measures the temperature of the fixing member; and a second magnetic-circuit-producing member having a cut portion in which the temperature measuring device is provided and that produces a magnetic circuit of the alternating-current magnetic field while conducting heat to the fixing member by being induction-heated.

5 Claims, 15 Drawing Sheets

INDUCTION HEATED FIXING DEVICE AND IMAGE FORMING APPARATUS

CROSS-REFERENCE TO RELATED APPLICATIONS

This application is based on and claims priority under 35 USC 119 from Japanese Patent Application No. 2012-201896 filed Sep. 13, 2012.

BACKGROUND

Technical Field

The present invention relates to a fixing device and an image forming apparatus.

SUMMARY

According to an aspect of the invention, there is provided a fixing device including a fixing member including a conductive layer and that fixes toner on a recording material while the conductive layer is induction-heated; a magnetic-field-producing unit including an exciting member that produces an alternating-current magnetic field intersecting the conductive layer of the fixing member, and first magnetic-circuit-producing members that each produce a magnetic circuit of the alternating-current magnetic field produced by the exciting member, the first magnetic-circuit-producing members including members provided at a predetermined first interval in a scanning direction and members provided at a second interval in the scanning direction, the second interval being smaller than the first interval; a temperature measuring device provided in contact with an inner circumferential surface of the fixing member and that measures the temperature of the fixing member; and a second magnetic-circuit-producing member having a cut portion in which the temperature measuring device is provided, the second magnetic-circuit-producing member being in contact with the inner circumferential surface of the fixing member and producing a magnetic circuit of the alternating-current magnetic field produced by the magnetic-field-producing unit, the second magnetic-circuit-producing member conducting heat to the fixing member by being induction-heated. The first magnetic-circuit-producing members at the second interval are provided on both sides of a position corresponding to the cut portion of the second magnetic-circuit-producing member in a direction in which the magnetic circuit is produced, and the first magnetic-circuit-producing members at the first interval are provided at other positions.

BRIEF DESCRIPTION OF THE DRAWINGS

An exemplary embodiment of the present invention will be described in detail based on the following figures, wherein.

DETAILED DESCRIPTION

An exemplary embodiment of the present invention will now be described in detail with reference to the accompanying drawings.

Image Forming Apparatus

Figure 1:
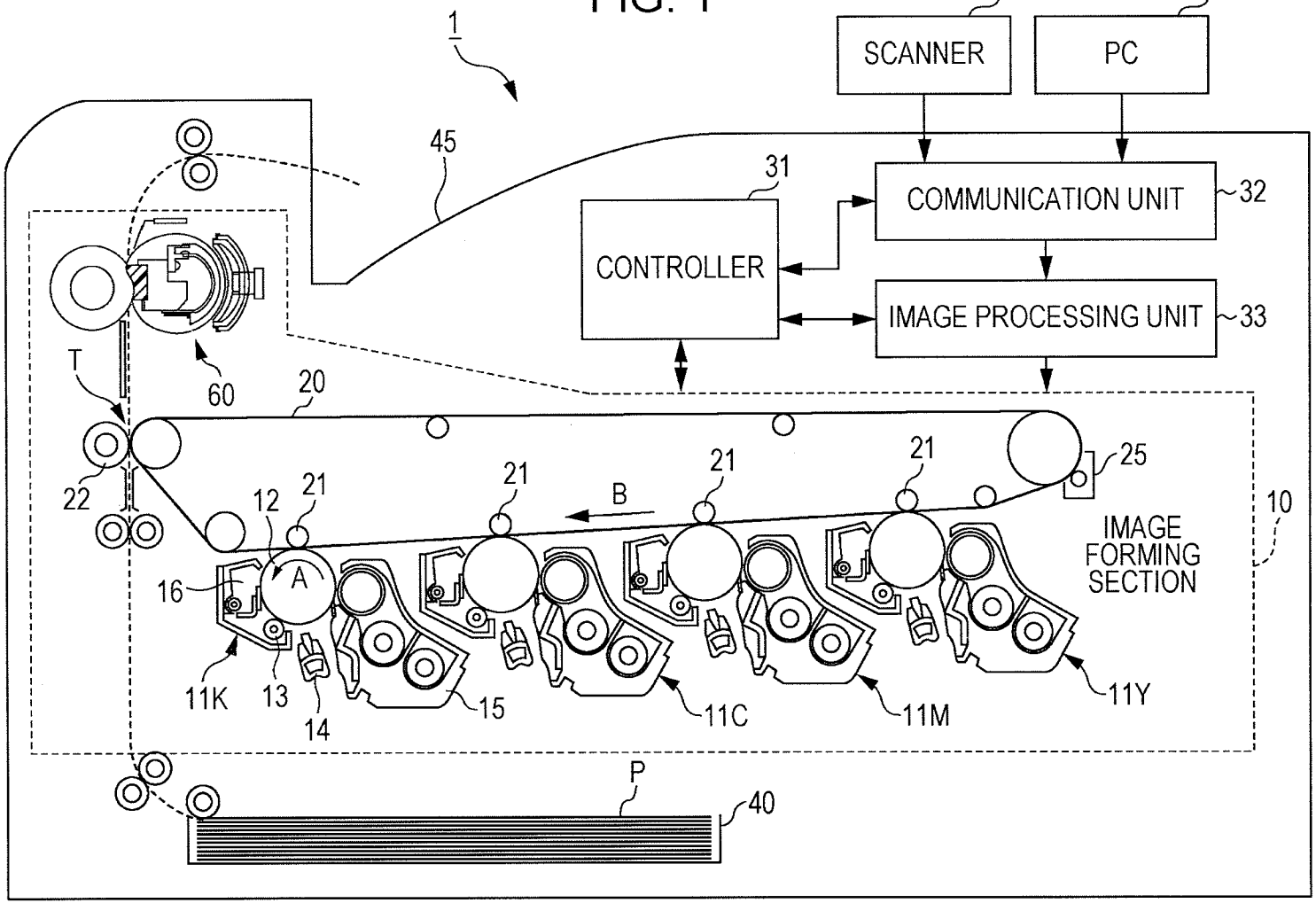
FIG. 1 illustrates an exemplary image forming apparatus to which a fixing device according to the exemplary embodiment is applied.

FIG. 1 illustrates an exemplary image forming apparatus 1 to which a fixing device according to the exemplary embodiment is applied. The image forming apparatus 1 illustrated in FIG. 1 is a tandem color printer and includes an image forming section 10 that forms an image on the basis of image data, a controller 31 that controls the overall operation of the image forming apparatus 1, a communication unit 32 that communicates with, for example, a personal computer (PC) 3 or an image reading device (scanner) 4 and receives the image data, and an image processing unit 33 that performs a predetermined image processing operation on the image data received by the communication unit 32.

The image forming section 10 includes four image forming units 11Y, 11M, 11C, and 11K (also generally referred to as "image forming units 11") as exemplary toner-image-forming sections that are provided side by side at predetermined intervals. The image forming units 11 each include a photoconductor drum 12 as an exemplary image carrier on which an electrostatic latent image is to be formed and thus carries a toner image, a charging device 13 that charges the surface of the photoconductor drum 12 with a predetermined potential, a light-emitting-diode (LED) printhead 14 that performs, on the basis of image data for a corresponding one of different colors, exposure on the photoconductor drum 12 charged by the charging device 13, a developing device 15 that develops the electrostatic latent image formed on the photoconductor drum 12, and a drum cleaner 16 that cleans the surface of the photoconductor drum 12 after image transfer.

The image forming units 11 all have substantially the same configuration except toners contained in the respective developing devices 15. The image forming units 11 form toner images in yellow (Y), magenta (M), cyan (C), and black (K), respectively.

The image forming section 10 also includes an intermediate transfer belt 20 to which the toner images in different colors formed on the photoconductor drums 12 of the respective image forming units 11 are multiply transferred, first transfer rollers 21 with which the toner images in different colors formed by the respective image forming units 11 are sequentially transferred (first-transferred) to the intermediate transfer belt 20 in such a manner as to be superposed one on top of another, a second transfer roller 22 with which the toner images in different colors superposed on the intermediate transfer belt 20 are transferred at a time (second-transferred) to paper P as a recording material (recording paper), and a fixing unit 60 as an exemplary fixing section (fixing device) that fixes the second-transferred toner images in different colors on the paper P. In the image forming apparatus 1 according to the exemplary embodiment, the intermediate transfer belt 20, the first transfer rollers 21, and the second transfer roller 22 in combination form a transfer section.

The image forming apparatus 1 according to the exemplary embodiment performs an image forming operation in the following process under the control of the controller 31. Specifically, image data from the PC 3 or the scanner 4 is received by the communication unit 32 and is subjected to the predetermined image processing operation performed by the image processing unit 33, thereby being converted into pieces of image data for the respective colors. The pieces of image data are transmitted to the respective image forming units 11. For example, in the image forming unit 11K that forms a black (K)-colored toner image, the photoconductor drum 12 rotating in the direction of arrow A is charged with the predetermined potential by the charging device 13, and the LED printhead 14 performs scan exposure on the photoconductor drum 12 on the basis of the piece of image data for the K color transmitted from the image processing unit 33. Thus, an electrostatic latent image for a K-colored image is formed on the photoconductor drum 12. The electrostatic latent image for the K color on the photoconductor drum 12 is developed by the developing device 15, whereby a K-colored toner image is formed on the photoconductor drum 12. Likewise, yellow (Y)-colored, magenta (M)-colored, and cyan (C)-colored toner images are formed by the other image forming units 11Y, 11M, and 11C, respectively.

The different-colored toner images thus formed on the photoconductor drums 12 of the respective image forming units 11 are sequentially electrostatically transferred (first-transferred) to the intermediate transfer belt 20 rotating in the direction of arrow B by the respective first transfer rollers 21, whereby a superposition of toner images in which the different-colored toner images are superposed one on top of another is formed. The superposition of toner images on the intermediate transfer belt 20 is transported, with the rotation of the intermediate transfer belt 20, to an area (second transfer part T) where the second transfer roller 22 is provided. In accordance with the timing when the superposition of toner images reaches the second transfer part T, paper P fed from a paper holder 40 is transported to the second transfer part T. Subsequently, at the second transfer part T, the superposition of toner images is electrostatically transferred at a time (second-transferred) to the thus transported paper P by an effect of a transfer electric field produced by the second transfer roller 22.

Subsequently, the paper P having the superposition of toner images electrostatically transferred thereto is transported to the fixing unit 60. The superposition of toner images on the paper P transported to the fixing unit 60 is subjected to heat and pressure applied by the fixing unit 60 and is thus fixed on the paper P. The paper P having the fixed image is transported to a paper stacking part 45 provided in a paper output portion of the image forming apparatus 1.

Meanwhile, toners adhering to the photoconductor drums 12 after the first transfer (first-transfer residual toner) and toners adhering to the intermediate transfer belt 20 after the second transfer (second-transfer residual toner) are removed by the drum cleaners 16 and a belt cleaner 25, respectively.

The image forming apparatus 1 repeats the above image forming operation for the number of pages to be printed.

Fixing Unit

The fixing unit 60 according to the exemplary embodiment will now be described.

Figure 2:
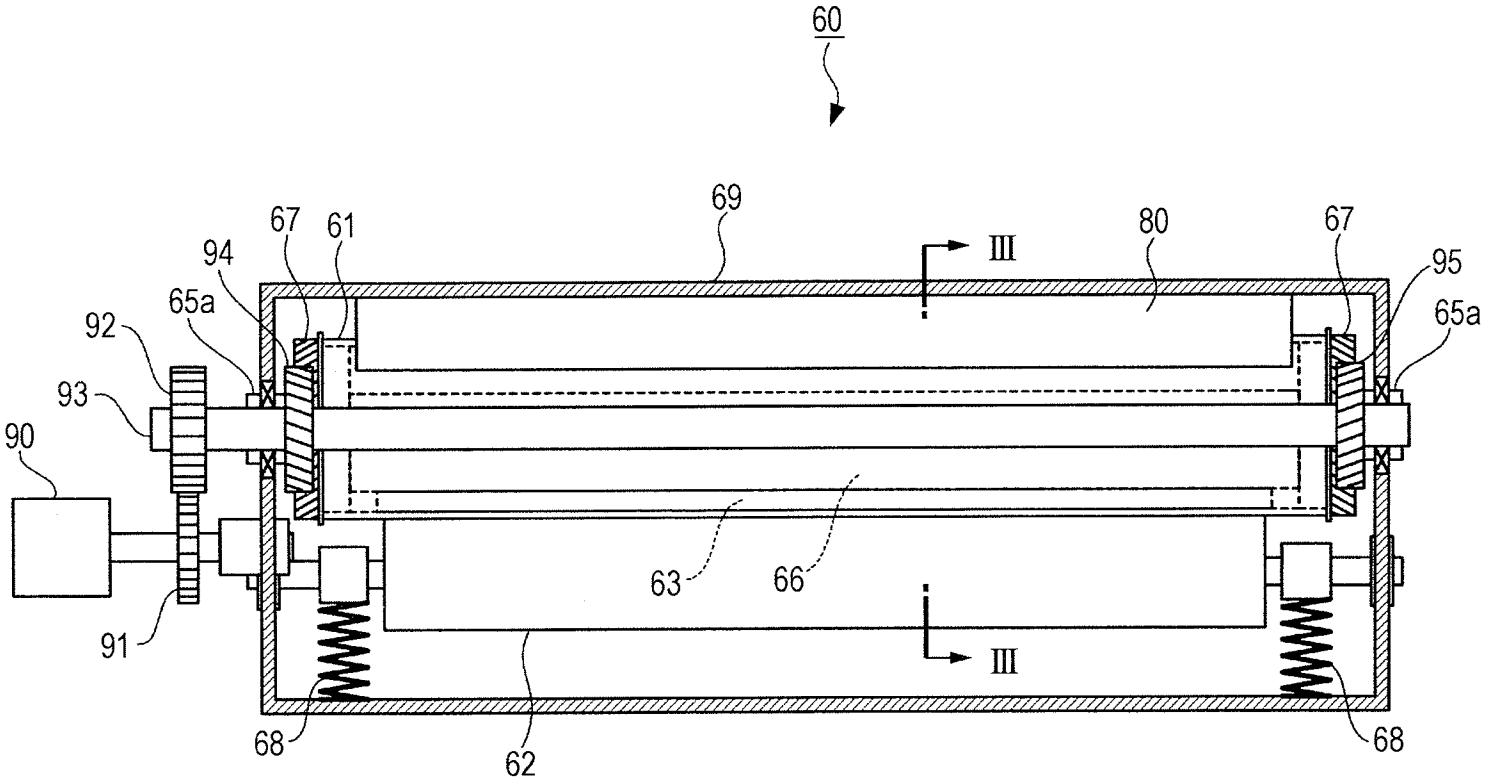
FIG. 2 is a front view of the fixing device according to the exemplary embodiment.
Figure 3:
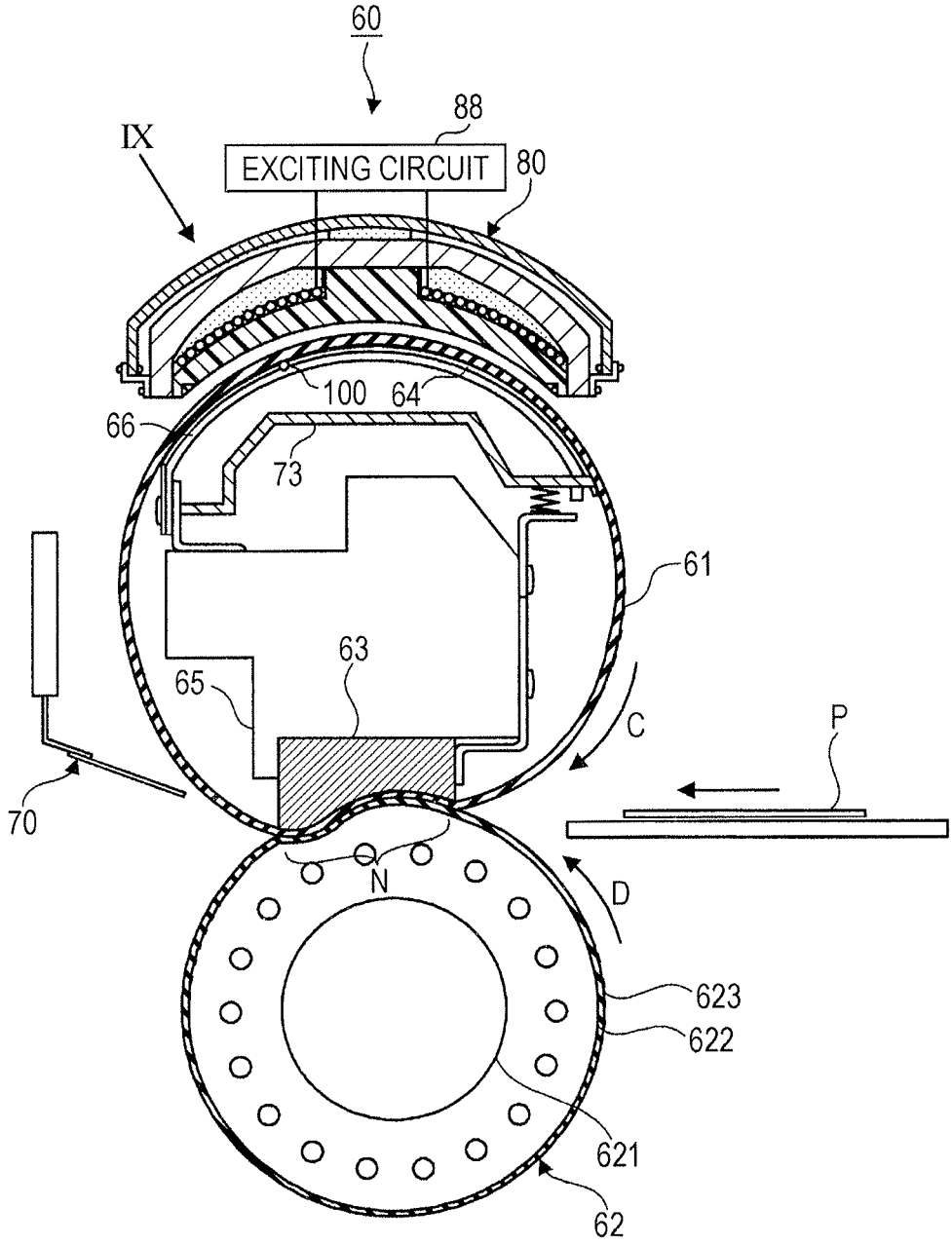
FIG. 3 is a sectional view of the fixing device taken along line III-III illustrated in FIG. 2.

FIGS. 2 and 3 illustrate the fixing unit 60 according to the exemplary embodiment. FIG. 2 is a front view. FIG. 3 is a sectional view taken along line III-III illustrated in FIG. 2.

Referring to the sectional view in FIG. 3, the fixing unit 60 includes an induction-heating (IH) heater 80 as an exemplary magnetic-field-producing unit that produces an alternating-current magnetic field, a fixing belt 61 as an exemplary fixing member that is induction-heated by the IH heater 80 and thus fixes toner images, a pressure applying roller 62 as an exemplary fixing-pressure-applying member that faces the fixing belt 61, and a pressure receiving pad 63 against which the pressure applying roller 62 is pressed with the fixing belt 61 interposed therebetween.

The fixing unit 60 further includes a frame 65 that supports the pressure receiving pad 63 and other elements, a temperature-sensitive magnetic member 64 that produces a magnetic circuit by inducing thereinto the alternating-current magnetic field produced by the IH heater 80, a good-thermal-conductivity heat storage member 66 that is in contact with the temperature-sensitive magnetic member 64 and has a function of storing heat and evening out the temperature in the longitudinal direction of the fixing unit 60, a magnetic-circuit-blocking member 73 that prevents the magnetic circuit from extending toward a side thereof nearer to the frame 65, a release assisting member 70 that assists releasing of the paper P from the fixing belt 61, and a temperature sensor 100 as an exemplary temperature measuring device that is in contact with the inner circumferential surface of the fixing belt 61 and measures the temperature of the fixing belt 61.

Fixing Belt

Figure 4:
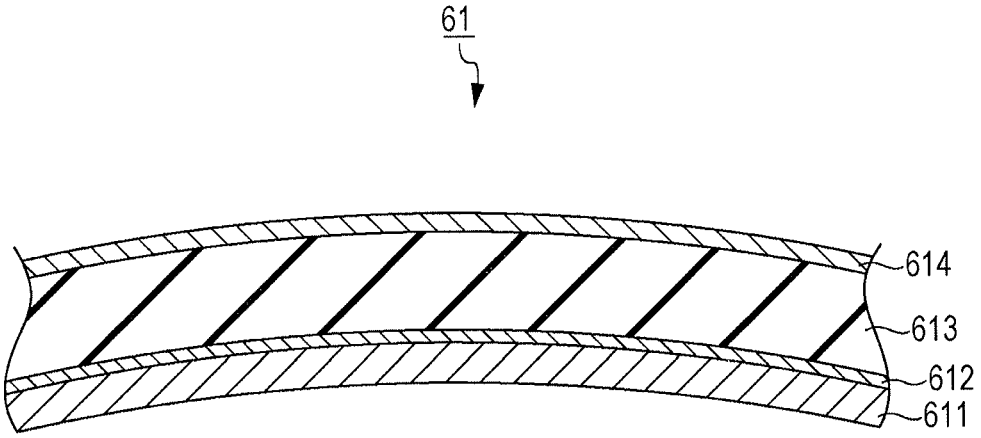
FIG. 4 is a sectional view illustrating layers included in a fixing belt.

The fixing belt 61 is an endless belt member that originally has a round cylindrical shape with, for example, a diameter of 30 mm in its original shape (round cylindrical shape) and a length of 370 mm. Referring to FIG. 4 (a sectional view illustrating layers included in the fixing belt 61), the fixing belt 61 is a multilayer belt member including a base layer 611, a conductive heating layer 612 that overlies the base layer 611, an elastic layer 613 that improves the capability of fixing toner images, and a surficial release layer 614 that is provided as the outermost layer.

The base layer 611 supports the conductive heating layer 612 and is a heat-resistant sheet-like member that provides good mechanical strength to the fixing belt 61 as a whole. The base layer 611 is made of a material having a thickness and physical properties (relative permeability and resistivity) that allow the alternating-current magnetic field produced by the IH heater 80 to pass therethrough and to act on the temperature-sensitive magnetic member 64. The base layer 611 itself, however, does not generate heat or hardly generates heat with the magnetic field.

Specifically, for example, the base layer 611 has a thickness of 30 μm to 200 μm (preferably, 50 μm to 150 μm) and is made of non-magnetic metal such as non-magnetic stainless steel, a resin material having a thickness of 60 μm to 200 μm, or the like.

The conductive heating layer 612 is an exemplary conductive layer and is an induction-heated layer that is heated by electromagnetic induction caused by the alternating-current magnetic field produced by the IH heater 80. That is, an eddy current occurs in the conductive heating layer 612 when the alternating-current magnetic field produced by the IH heater 80 passes through the conductive heating layer 612 in the thickness direction.

Usually, a general-purpose power supply that is manufacturable at a low cost is used as the power source for an exciting circuit 88 (see FIG. 6 to be referred to below also) that supplies an alternating current to the IH heater 80. Therefore, the frequency of the alternating-current magnetic field produced by the IH heater 80 usually ranges from 20 kHz to 100 kHz, corresponding to the frequency of the general-purpose power supply. Hence, the conductive heating layer 612 is configured to allow an alternating-current magnetic field at a frequency of 20 kHz to 100 kHz to enter and pass therethrough.

The alternating-current magnetic field is allowed to enter a region of the conductive heating layer 612 where the alternating-current magnetic field is attenuated to 1/e. The region is defined by "skin depth (δ)", which is obtained by the following expression:

$$\delta = 503\sqrt{\frac{\rho}{f \cdot \mu_r}} \tag{1}$$

where f denotes the frequency of the alternating-current magnetic field (20 kHz, for example), ρ denotes the resistivity (Ω·m), and $\mu_r$ denotes the relative permeability.

Hence, the conductive heating layer 612 is thinner than the skin depth (δ) defined by Expression (1) so that an alternating-current magnetic field at a frequency of 20 kHz to 100 kHz is allowed to enter and pass through the conductive heating layer 612. Exemplary materials for the conductive heating layer 612 include metals such as Au, Ag, Al, Cu, Zn, Sn, Pb, Bi, Be, and Sb, and alloys of any of the foregoing metals.

Specifically, for example, the conductive heating layer 612 has a thickness of 2 μm to 20 μm and a resistivity of $2.7\times10^{-8}$ Ω·m or smaller and is made of a non-magnetic metal such as Cu (a paramagnetic material having a relative permeability of about 1).

The conductive heating layer 612 may have such a small thickness in terms of reducing the time required for heating the fixing belt 61 to a preset fixing temperature (hereinafter referred to as "warm-up time").

The elastic layer 613 is made of a heat-resistant elastic material such as silicone rubber. Toner images on the paper P, i.e., the object of fixing, are layers of powder toners having different colors. Therefore, to heat the entirety of the toner images uniformly at a nip part N, the surface of the fixing belt 61 may be deformable along a rugged surface formed by the toner images on the paper P. In such a case, silicone rubber having, for example, a thickness of 100 μm to 600 μm and a hardness of 10° to 30° (JIS-A) is suitable for the elastic layer 613.

The surficial release layer 614 directly comes into contact with unfixed toner images on the paper P and is therefore made of a material having a high releasability. Examples of such a material include a tetrafluoroethylene-perfluoroalkyl vinyl ether copolymer (PFA), polytetrafluoroethylene (PTFE), a silicone copolymer, and a composite of any of the foregoing materials. If the surficial release layer 614 is too thin, abrasion resistance is insufficient and the life of the fixing belt 61 is shortened. In contrast, if the surficial release layer 614 is too thick, the heat capacity of the fixing belt 61 is too large and the warm-up time increases. Considering the balance between abrasion resistance and heat capacity, the thickness of the surficial release layer 614 may be 1 μm to 50 μm.

Drive Mechanism for Fixing Belt

A mechanism that drives the fixing belt 61 will now be described.

Referring to the front view in FIG. 2, the frame 65 (see FIG. 3) has end cap members 67 that are secured at two axial ends thereof and via which the fixing belt 61 is rotated in the circumferential direction thereof while the round sectional shape of the fixing belt 61 are retained at the two ends. The fixing belt 61 directly receives at the two ends thereof a rotational driving force from the end cap members 67 and thus rotates in the direction of arrow C illustrated in FIG. 3 at a process speed of, for example, 140 mm/s.

Figure 5A:
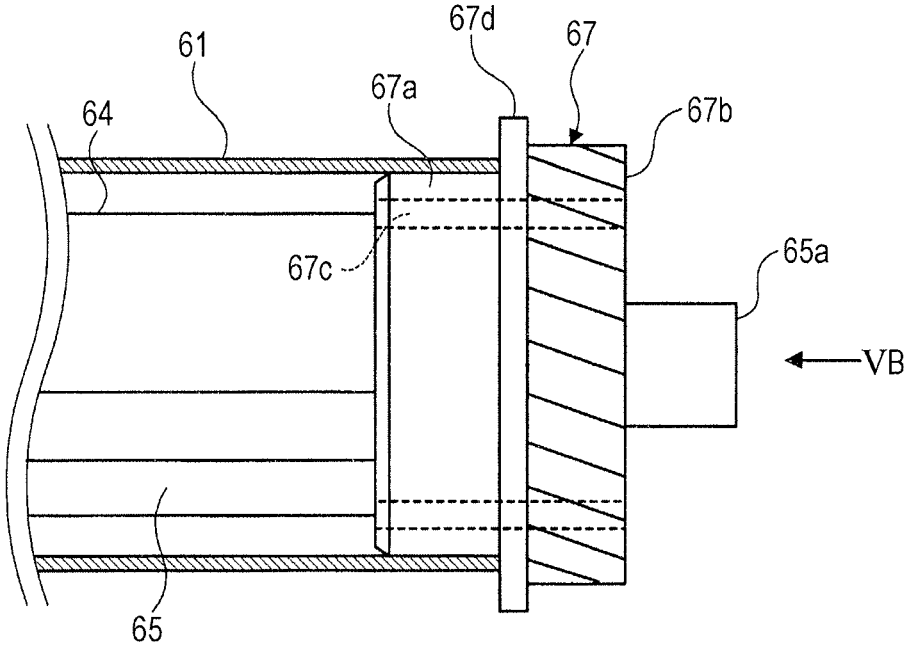
FIG. 5A is a side view illustrating one of end cap members.
Figure 5B:
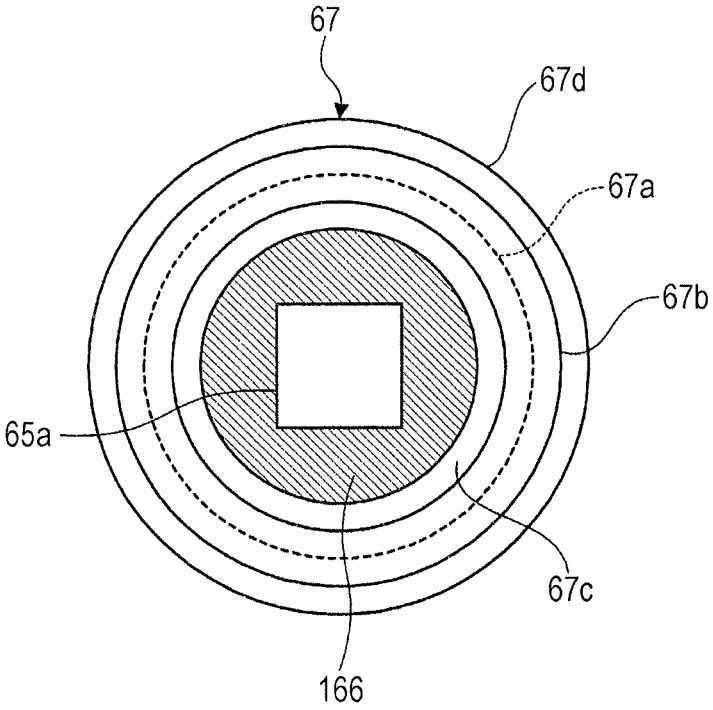
FIG. 5B is a plan view of the end cap member seen in the direction of arrow VB illustrated in FIG. 5A.

FIG. 5A is a side view illustrating one of the end cap members 67. FIG. 5B is a plan view of the end cap member 67 seen in the direction of arrow VB illustrated in FIG. 5A. Referring to FIGS. 5A and 5B, each end cap member 67 includes a securing portion 67*a* that is fitted in a corresponding one of the ends of the fixing belt 61, a flange portion 67*d* that has a larger outside diameter than the securing portion 67*a* and radially extends beyond the fixing belt 61 in a state where the end cap member 67 is fitted in the fixing belt 61, a gear portion 67*b* to which the rotational driving force is transmitted, and a bearing portion 67*c* that is rotatably connected to a corresponding one of supporting portions 65*a* via a corresponding one of connecting members 166. The supporting portions 65*a* are provided at the two ends of the frame 65. Referring to FIG. 2, the supporting portions 65*a* at the two ends of the frame 65 are fixed to the two respective ends of a housing 69 of the fixing unit 60, whereby the end cap members 67 are rotatably supported via the respective bearing portions 67*c* connected to the supporting portions 65*a*.

The end cap members 67 are made of an engineering plastic having high mechanical strength and high heat resistance, such as phenolic resin, polyimide resin, polyamide resin, polyamide-imide resin, polyether ether keton (PEEK), polyether sulfone (PES), polyphenylene sulfide (PPS), or liquid crystal polymer (LCP).

As illustrated in FIG. 2, in the fixing unit 60, a rotational driving force is transmitted from a drive motor 90 as an exemplary drive unit to a shaft 93 via transmission gears 91 and 92 and to the gear portions 67*b* (see FIGS. 5A and 5B) of the two end cap members 67 via respective transmission gears 94 and 95 connected to the shaft 93. In this manner, the rotational driving force is transmitted from the end cap members 67 to the fixing belt 61, and the end cap members 67 and the fixing belt 61 rotate together.

Since the fixing belt 61 rotates by directly receiving the driving force at the two ends thereof, the fixing belt 61 rotates stably.

Referring now to FIG. 3, the pressure applying roller 62 faces the fixing belt 61 and rotates in the direction of arrow D illustrated in FIG. 3 at a process speed of, for example, 140 mm/s by following the rotation of the fixing belt 61. The nip part N is formed in a state where the fixing belt 61 is nipped between the pressure applying roller 62 and the pressure receiving pad 63. When paper P having unfixed toner images is transported through the nip part N, heat and pressure are applied to the unfixed toner images, whereby the unfixed toner images are fixed on the paper P.

The pressure applying roller 62 includes a solid aluminum core (round-columnar metal core) 621 having an exemplary diameter of 18 mm, a heat-resistant elastic layer 622 made of silicone sponge or the like having an exemplary thickness of 5 mm and provided over the outer periphery of the core 621, and a release layer 623 as a heat-resistant resin coating composed of carbon-filled PFA or the like or a heat-resistant rubber coating, the release layer 623 having an exemplary thickness of 50 μm. The pressure applying roller 62 presses the pressure receiving pad 63 with the fixing belt 61 interposed therebetween and with an exemplary load of 25 kgf exerted by pressing springs 68 (see FIG. 2).

Temperature-Sensitive Magnetic Member

The temperature-sensitive magnetic member 64 according to the exemplary embodiment acts as a ferromagnetic body at and below a temperature at which magnetic permeability starts to change. Therefore, the temperature-sensitive magnetic member 64 generates heat by itself through induction heating. When fixing is performed, the fixing belt 61 is deprived of its heat and the temperature of the fixing belt 61 drops. However, the fixing belt 61 is reheated by a combination of the heat generated from the fixing belt 61 by induction heating and the heat generated by the temperature-sensitive magnetic member 64. Therefore, the temperature of the fixing belt 61 quickly rises to a preset fixing temperature with the heat conducting through the fixing belt 61.

The temperature-sensitive magnetic member 64 has an arc shape extending along the inner circumferential surface of the fixing belt 61. The temperature-sensitive magnetic member 64 is provided in contact with the inner circumferential surface of the fixing belt 61 so as to facilitate the supply of heat generated by induction heating from the temperature-sensitive magnetic member 64 to the fixing belt 61. To supply heat to the fixing belt 61, the temperature-sensitive magnetic member 64 is kept at a temperature higher than the temperature of the fixing belt 61 by 20° C. to 30° C.

The temperature-sensitive magnetic member 64 is made of such a material that the temperature at which the magnetic permeability, one of magnetic properties, of the material suddenly changes (described separately below) is at or above the preset fixing temperature, at which toner images in different colors melt, and below the heat-resistant temperatures of the elastic layer 613 and the surficial release layer 614 of the fixing belt 61. In other words, the temperature-sensitive magnetic member 64 is made of a material exhibiting "temperature-sensitive magnetism", that is, the temperature-sensitive magnetic member 64 changes reversibly between exhibiting ferromagnetism and non-magnetism (paramagnetism) in a temperature range including the preset fixing temperature. In a temperature range in which the temperature-sensitive magnetic member 64 exhibits ferromagnetism, i.e., at or below the temperature at which magnetic permeability starts to change, the temperature-sensitive magnetic member 64 functions as a second magnetic-circuit-producing member that induces thereinto lines of magnetic force produced by the IH heater 80 and intersecting the fixing belt 61, thereby producing a magnetic circuit of an alternating-current magnetic field (lines of magnetic force), part of which runs through the temperature-sensitive magnetic member 64. Thus, the temperature-sensitive magnetic member 64 produces a closed magnetic circuit enclosing the fixing belt 61 and an exciting coil 82 (see FIG. 6 to be referred to below) of the IH heater 80. In contrast, above the temperature at which magnetic permeability starts to change, the temperature-sensitive magnetic member 64 allows the lines of magnetic force produced by the IH heater 80 and intersecting the fixing belt 61 to pass therethrough in the thickness direction of the temperature-sensitive magnetic member 64. Thus, the lines of magnetic force produced by the IH heater 80 and intersecting the fixing belt 61 form a magnetic circuit intersecting the temperature-sensitive magnetic member 64, running through the good-thermal-conductivity heat storage member 66, and returning to the IH heater 80.

The "temperature at which magnetic permeability starts to change" refers to a temperature at which magnetic permeability (measured in accordance with JIS C2531, for example) starts to drop continuously, specifically, a temperature at which the amount of magnetic flux (the number of lines of magnetic force) permeating through the temperature-sensitive magnetic member 64 and other elements starts to change. That is, the temperature at which magnetic permeability starts to change is close to the Curie point, at which materials lose their magnetism, but is based on a concept different from the Curie point.

The temperature-sensitive magnetic member 64 is made of such a material that the temperature at which magnetic permeability starts to change is set so as to be within the range of, for example, 140° C. (the preset fixing temperature) to 240° C. Examples of such a material include binary magnetic shunt steel such as an Fe—Ni alloy (permalloy), and ternary magnetic shunt steel such as an Fe—Ni—Cr alloy. In the case of an Fe—Ni binary magnetic shunt steel, the temperature at which magnetic permeability starts to change may be set to about 225° C. in a proportion (atomic ratio) of about 64% for Fe to about 36% for Ni. Metal alloys such as permalloys and magnetic shunt steel are easy to mold and easy to machine, have high thermal conductivity, and are inexpensive. Therefore, such metal alloys are suitable for the temperature-sensitive magnetic member 64. Exemplary components of such metal alloys include Fe, Ni, Si, B, Nb, Cu, Zr, Co, Cr, V, Mn, and Mo.

The temperature-sensitive magnetic member 64 is made thicker than the skin depth δ (see Expression (1) above) that allows entry of the alternating-current magnetic field (lines of magnetic force) produced by the IH heater 80. For example, in the case of an Fe—Ni alloy, the thickness of the temperature-sensitive magnetic member 64 is set to about 200 μm to about 800 μm.

Good-Thermal-Conductivity Heat Storage Member

The good-thermal-conductivity heat storage member 66 according to the exemplary embodiment has an arc shape extending along the inner circumferential surface of the temperature-sensitive magnetic member 64 and is in contact with the inner circumferential surface of the temperature-sensitive magnetic member 64. When the temperature-sensitive magnetic member 64 is heated to a temperature above the temperature at which magnetic permeability starts to change, the alternating-current magnetic field (lines of magnetic force) that has passed through the temperature-sensitive magnetic member 64 reaches the good-thermal-conductivity heat storage member 66, whereby an eddy current I generating lines of magnetic force acting in such a direction that the above lines of magnetic force are cancelled out occurs in the good-thermal-conductivity heat storage member 66. Specifically, the good-thermal-conductivity heat storage member 66 may have a predetermined thickness (1.0 mm, for example) much larger than the skin depth δ (see Expression (1) above) so as to allow the eddy current I to easily flow therethrough. In such a configuration, even if the eddy current I flows through the good-thermal-conductivity heat storage member 66, the amount of heat generation is minimized. In the exemplary embodiment, the good-thermal-conductivity heat storage member 66 is made of an aluminum (Al) member with a thickness of 1 mm and in a substantially round shape extending along the temperature-sensitive magnetic member 64. The good-thermal-conductivity heat storage member 66 is in contact with the inner circumferential surface of the temperature-sensitive magnetic member 64. Other materials suitable for the good-thermal-conductivity heat storage member 66 include Ag and Cu.

IH Heater

The IH heater 80 will now be described. The IH heater 80 performs electromagnetic induction heating by producing an alternating-current magnetic field acting on the conductive heating layer 612 of the fixing belt 61.

Figure 6:
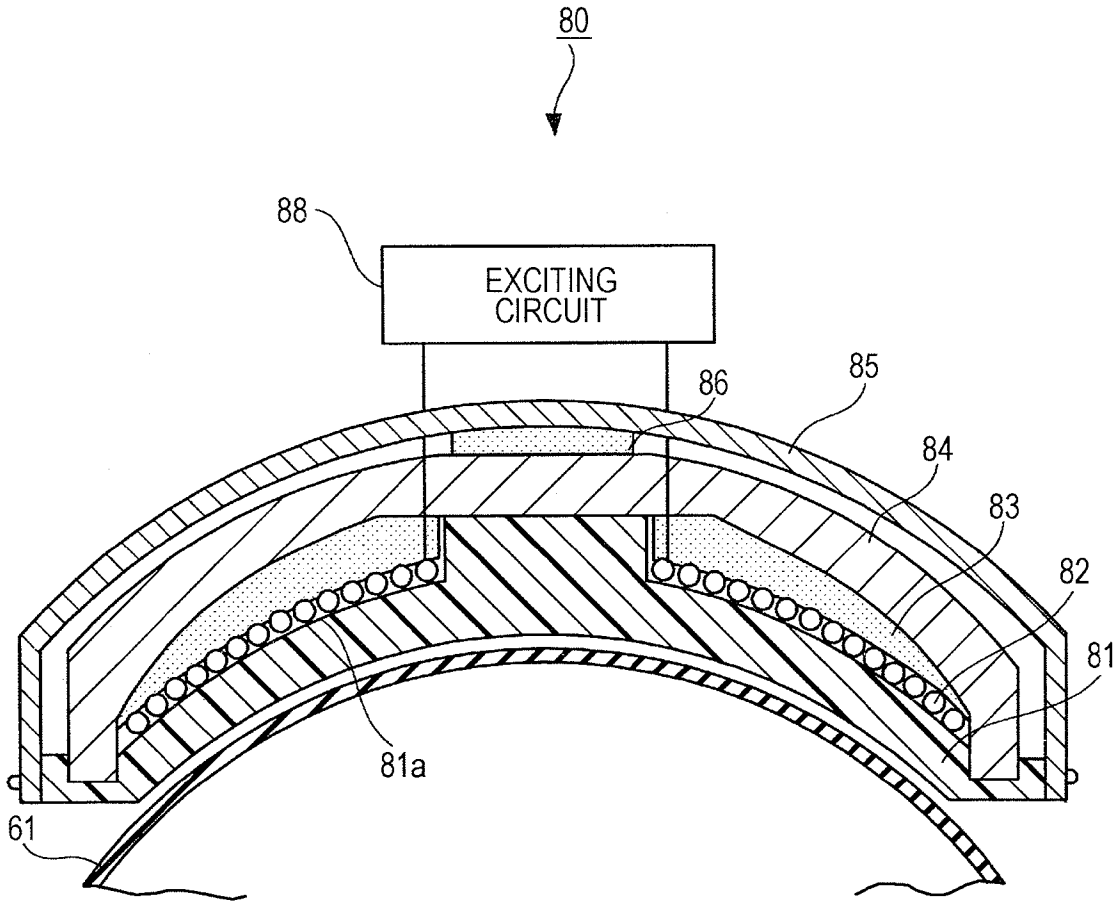
FIG. 6 is a sectional view of an induction-heating (IH) heater.

FIG. 6 is a sectional view of the IH heater 80 according to the exemplary embodiment. As illustrated in FIG. 6, the IH heater 80 includes a support 81 made of a non-magnetic material such as heat-resistant resin, the exciting coil 82 producing an alternating-current magnetic field, elastic supporting members 83 made of an elastic material and securing the exciting coil 82 on the support 81, a magnetic core 84 producing a magnetic circuit of the alternating-current magnetic field produced by the exciting coil 82, a shield 85 blocking the magnetic field, a pressing member 86 pressing the magnetic core 84 toward the support 81, and the exciting circuit 88 supplying an alternating current to the exciting coil 82.

The support 81 has a curved sectional shape extending along the surface of the fixing belt 61 and is positioned such that an upper surface (supporting surface) 81*a* of the support 81 supporting the exciting coil 82 is retained at a predetermined distance (0.5 mm to 2 mm, for example) from the surface of the fixing belt 61. The support 81 is made of a heat-resistant non-magnetic material: for example, heat-resistant glass; heat-resistant resin such as polycarbonate, polyether sulfone, or PPS; or a material obtained by adding glass fibers to the foregoing heat-resistant resin.

The exciting coil 82 is an exemplary exciting member that produces an alternating-current magnetic field intersecting the conductive heating layer 612 of the fixing belt 61. The exciting coil 82 is produced by coiling a Litz wire into a hollow closed loop having any shape such as an oblong circular shape, an elliptic shape, or a rectangular shape. The Litz wire is a bundle of, for example, 90 copper wires insulated from one another and each having a diameter of, for example, 0.17 mm. When an alternating current at a predetermined frequency is supplied from the exciting circuit 88 to the exciting coil 82, an alternating-current magnetic field centered on the Litz wire coiled into the closed loop is produced around the exciting coil 82. The frequency of the alternating current supplied from the exciting circuit 88 to the exciting coil 82 usually ranges from 20 kHz to 100 kHz, corresponding to the frequency of the alternating current generated by the above-mentioned general-purpose power supply.

The magnetic core 84 is a ferromagnetic body composed of an oxide or an alloy having high magnetic permeability such as soft ferrite, ferrite resin, an amorphous alloy, a permalloy, or magnetic shunt steel. The magnetic core 84 includes plural segments that are provided at predetermined intervals in a longitudinal direction of a fixing belt 61. The segments of the magnetic core 84 function as first magnetic-circuit-producing members that each produce a magnetic circuit of the alternating-current magnetic field produced by the exciting coil 82. The magnetic core 84 induces thereinto lines of magnetic force (magnetic flux) of the alternating-current magnetic field produced by the exciting coil 82 and produces a path of the lines of magnetic force (magnetic circuit) running from the magnetic core 84, intersecting the fixing belt 61 toward the temperature-sensitive magnetic member 64, running through the temperature-sensitive magnetic member 64, and returning to the magnetic core 84. That is, the alternating-current magnetic field produced by the exciting coil 82 runs through the magnetic core 84 and the temperature-sensitive magnetic member 64, producing a closed magnetic circuit with lines of magnetic force enclosing the fixing belt 61 and the exciting coil 82. Thus, the lines of magnetic force of the alternating-current magnetic field produced by the exciting coil 82 concentrate in a portion of the fixing belt 61 that faces the magnetic core 84.

The magnetic core 84 may be made of a material that causes a small loss in production of the magnetic circuit. Specifically, the magnetic core 84 may be used in a form that reduces the eddy current loss (for example, a configuration in which the current path is cut off or divided with slits or the like, or a configuration including thin plates tied to one another) and may be made of a material causing a small hysteresis loss.

The length of the magnetic core 84 in the direction of rotation of the fixing belt 61 is smaller than the length of the temperature-sensitive magnetic member 64 in the direction of rotation of the fixing belt 61. Thus, leakage of lines of magnetic force around the IH heater 80 is reduced, and the power factor is increased. Moreover, electromagnetic induction into metal members included in the fixing unit 60 is suppressed, and the efficiency in heating the fixing belt 61 (the conductive heating layer 612) is increased.

How Fixing Belt Generates Heat

How the fixing belt 61 generates heat with the alternating-current magnetic field produced by the IH heater 80 will now be described.

As described above, the temperature at which the magnetic permeability of the temperature-sensitive magnetic member 64 starts to change is set so as to be at or above the preset fixing temperature at which toner images in different colors are fixed and at or below the heat resistant temperature of the fixing belt 61, for example, 140° C. to 240° C. When the fixing belt 61 is at or below the temperature at which magnetic permeability starts to change, the temperature-sensitive magnetic member 64 provided close to the fixing belt 61 is also at or below the temperature at which magnetic permeability starts to change, correspondingly to the fixing belt 61. In this state, the temperature-sensitive magnetic member 64 is ferromagnetic, and there is produced a magnetic circuit in which lines of magnetic force H of the alternating-current magnetic field produced by the IH heater 80 intersect the fixing belt 61 and run through the temperature-sensitive magnetic member 64 in a spreading direction. Here, the term "spreading direction" refers to a direction orthogonal to the thickness direction of the temperature-sensitive magnetic member 64.

Figure 7:
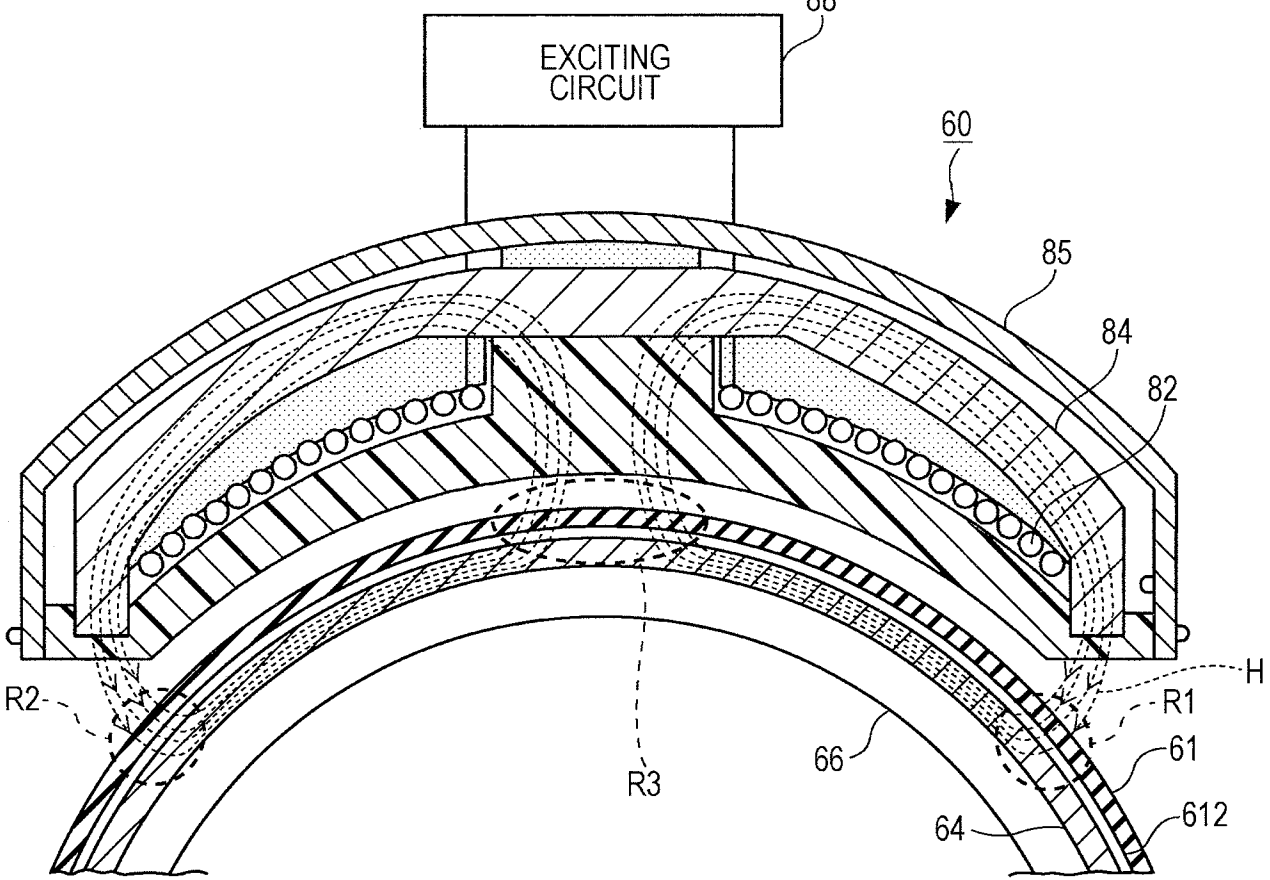
FIG. 7 illustrates lines of magnetic force produced when the fixing belt is at or below a temperature at which magnetic permeability starts to change.

FIG. 7 illustrates lines of magnetic force H when the fixing belt 61 is at or below the temperature at which magnetic permeability starts to change. As illustrated in FIG. 7, when the fixing belt 61 is at or below the temperature at which magnetic permeability starts to change, the lines of magnetic force H of the alternating-current magnetic field produced by the IH heater 80 form a magnetic circuit intersecting the fixing belt 61 and running through the temperature-sensitive magnetic member 64 in the spreading direction (the direction orthogonal to the thickness direction). Therefore, the number of lines of magnetic force H per unit area (magnetic flux density) in each region of the fixing belt 61 where the lines of magnetic force H intersect the conductive heating layer 612 is large.

Specifically, after the lines of magnetic force H radiated from the magnetic core 84 of the IH heater 80 pass through the conductive heating layer 612 of the fixing belt 61 in regions R1 and R2, the lines of magnetic force H are induced into the temperature-sensitive magnetic member 64 that is ferromagnetic. Therefore, the lines of magnetic force H intersecting the conductive heating layer 612 of the fixing belt 61 in the thickness direction concentrate in such a manner as to enter the temperature-sensitive magnetic member 64. Accordingly, the magnetic flux density is high in the regions R1 and R2. Furthermore, when the lines of magnetic force H that have run through the temperature-sensitive magnetic member 64 in the spreading direction return to the magnetic core 84 through a region R3 where the lines of magnetic force H intersect the conductive heating layer 612 in the thickness direction, the lines of magnetic force H are concentratedly produced from portions of the temperature-sensitive magnetic member 64 having low magnetic potentials toward the magnetic core 84. Therefore, the lines of magnetic force H intersecting the conductive heating layer 612 of the fixing belt 61 in the thickness direction are concentratedly radiated from the temperature-sensitive magnetic member 64 toward the magnetic core 84, increasing the magnetic flux density in the region R3.

In the conductive heating layer 612 of the fixing belt 61 in which the lines of magnetic force H intersect in the thickness direction, an eddy current I occurs in proportion to the amount of change in the number of lines of magnetic force H per unit area (magnetic flux density). Therefore, as illustrated in FIG. 7, a large eddy current I occurs in each of the regions R1 and R2 and the region R3 where the amount of change in the magnetic flux density is large. The eddy current I occurring in the conductive heating layer 612 generates Joule heat W ($W=I^2R$), which is the product of the resistivity R of the conductive heating layer 612 and the square of the eddy current I. Hence, in each of the regions of the conductive heating layer 612 where a large eddy current I occurs, high Joule heat W is generated.

Thus, when the fixing belt 61 is at or below the temperature at which magnetic permeability starts to change, high heat is generated in the regions R1 and R2 and the region R3 where the lines of magnetic force H intersect the conductive heating layer 612. Consequently, the fixing belt 61 is heated.

In the fixing unit 60 according to the exemplary embodiment, the temperature-sensitive magnetic member 64 is provided in contact with the fixing belt 61 on the inner circumferential side of the fixing belt 61. Thus, a configuration is realized in which the magnetic core 84 that induces thereinto the lines of magnetic force H produced by the exciting coil 82 and the temperature-sensitive magnetic member 64 that induces thereinto the lines of magnetic force H intersecting the fixing belt 61 in the thickness direction are provided close to each other. Accordingly, the alternating-current magnetic field produced by the IH heater 80 (exciting coil 82) forms a magnetic circuit in the form of a short loop. Such a magnetic circuit has a high magnetic flux density and a high degree of magnetic coupling. Therefore, when the fixing belt 61 is at or below the temperature at which magnetic permeability starts to change, the fixing belt 61 generates heat very efficiently.

Method of Securing Exciting Coil

A method of securing the exciting coil 82 to the support 81 in the IH heater 80 according to the exemplary embodiment will now be described.

In the IH heater 80 according to the exemplary embodiment, the elastic supporting members 83 that support the exciting coil 82 on the support 81 are made of an elastic material such as silicone rubber or fluororubber. The elastic supporting members 83 undergo elastic deformation while pressing the exciting coil 82 toward the support 81, whereby the exciting coil 82 is supported on the supporting surface 81*a* of the support 81. That is, the elastic supporting members 83 are made of a material having a small Young's modulus. When the elastic supporting members 83 press the exciting coil 82 toward the support 81, the elastic supporting members 83, having a small Young's modulus, undergo elastic deformation, whereby the exciting coil 82 is supported on the support 81.

Figure 8:
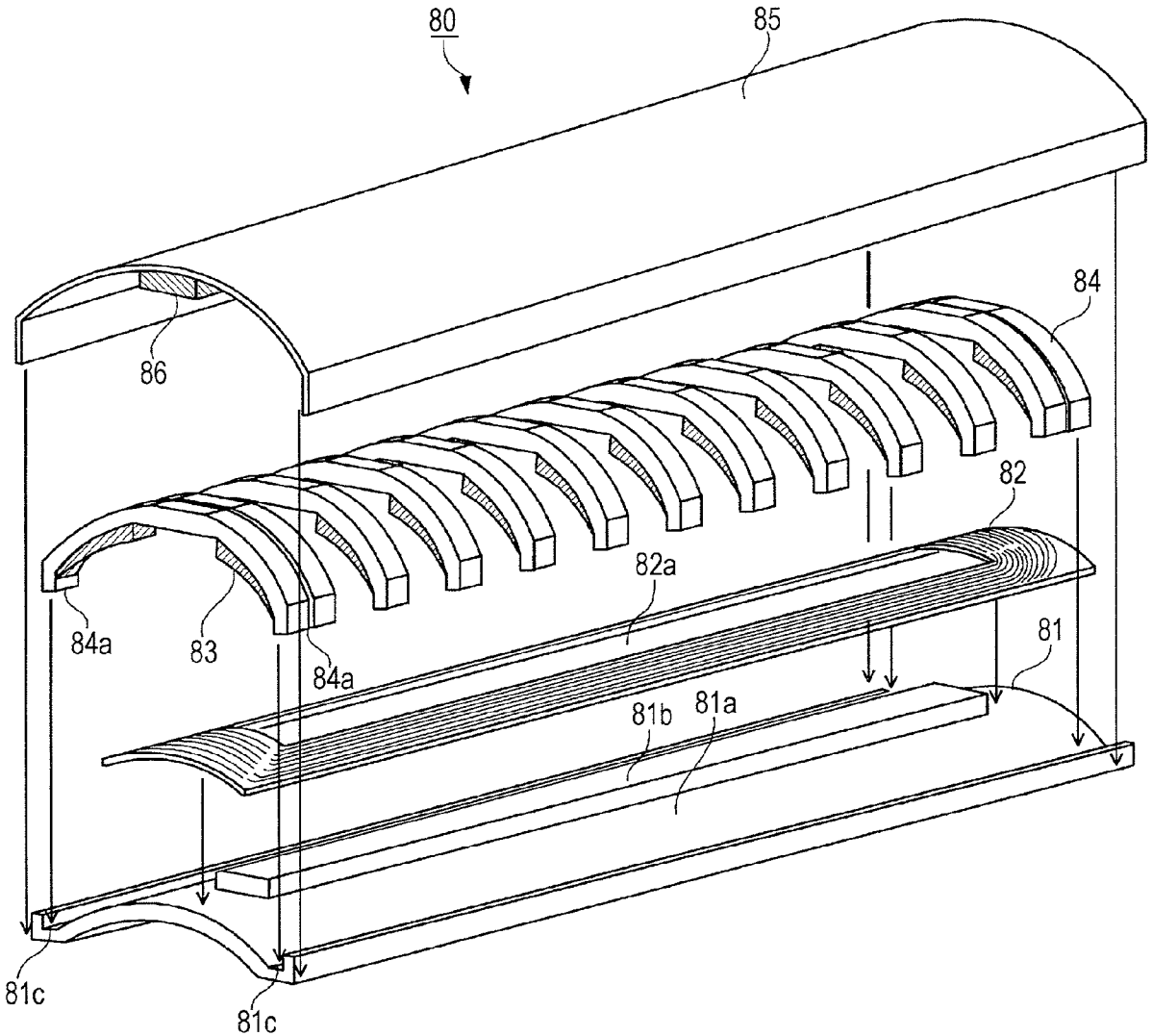
FIG. 8 illustrates a layered structure of the IH heater.

FIG. 8 illustrates a layered structure of the IH heater 80 according to the exemplary embodiment.

As illustrated in FIG. 8, the exciting coil 82 is provided on the supporting surface 81*a* of the support 81 such that a closed-loop hollow portion 82*a* of the exciting coil 82 fits around a projecting portion 81*b* extending along the longitudinal center axis of the supporting surface 81*a*. The supporting surface 81*a* functions as a positioning surface that is set at a specified distance (design value) from the fixing belt 61. The fixing belt 61 is supported by the above-described end cap members 67 (see FIG. 2) and rotates along a substantially circular locus. Hence, the distance between the exciting coil 82, which is on and in close contact with the supporting surface 81*a*, and the fixing belt 61 is set to the design value.

Therefore, in the IH heater 80 according to the exemplary embodiment, the exciting coil 82 provided on the supporting surface 81*a* of the support 81 is pressed toward the supporting surface 81*a* by the elastic supporting members 83. Specifically, the magnetic core 84 provided above the exciting coil 82 is attached to the support 81 such that two sides 84*a* of the magnetic core 84 are fitted into supporting rails 81*c* provided in two respective sides of the support 81 (see FIG. 6 also). Hence, the elastic supporting members 83 provided on the underside (a side nearer to the support 81) of the magnetic core 84 are in contact with the upper surface of the exciting coil 82. Meanwhile, since the shield 85 is attached to the support 81, the magnetic core 84 is pressed toward the support 81 by the pressing member 86 provided on the underside of the shield 85. Therefore, the exciting coil 82 receives an elastic force from the elastic supporting members 83 that receive a pressing force from the magnetic core 84, and is supported on the supporting surface 81*a* while being pressed toward the supporting surface 81*a* by the elastic supporting members 83 that undergo elastic deformation with the pressing force. In this manner, the exciting coil 82 is in close contact with the supporting surface 81*a*, and the distance between the exciting coil 82 and the fixing belt 61 is set to the design value.

The pressing member 86 may be an elastic body such as silicone rubber or fluororubber or an elastic member such as a spring.

In general, when an alternating-current magnetic field is produced by the exciting coil 82, a magnetic force acts between the magnetic core 84, which is provided near the exciting coil 82, and other members including the temperature-sensitive magnetic member 64 that are provided on the inner circumferential side of the fixing belt 61, whereby the exciting coil 82 itself vibrates (undergoes magnetostriction). In this state, the elastic supporting members 83, which are made of an elastic material, undergo elastic deformation in accordance with the vibration of the exciting coil 82 while absorbing the vibration of the exciting coil 82. Therefore, even if the number of total vibrations of the exciting coil 82 becomes large after a long use of the fixing unit 60, the elastic supporting members 83 are kept in contact with the exciting coil 82, maintaining the initially set positional relationship between the support 81 and the exciting coil 82.

In a manufacturing process, the thickness (a preset value) of the elastic supporting members 83 is controlled to fall within a range defined with a preset accuracy. Therefore, the pressing force of supporting the exciting coil 82 on the supporting surface 81*a* becomes substantially uniform in the longitudinal direction. Particularly, in the IH heater 80 according to the exemplary embodiment, plural segments of the magnetic core 84 that are arranged in the longitudinal direction of the exciting coil 82 press the exciting coil 82 uniformly over the entirety in the longitudinal direction. Therefore, the closeness between the exciting coil 82 and the supporting surface 81*a* is enhanced over the entirety in the longitudinal direction, whereby the positional relationship between the exciting coil 82 and the fixing belt 61 is set over the entirety in the longitudinal direction.

To attach the exciting coil 82 to the support 81, the exciting coil 82 needs to be secured so as not to be displaced on the supporting surface 81*a*. If any displacement occurs, the distance between the exciting coil 82 and the fixing belt 61 may deviate from the initial design value. Consequently, the density of lines of magnetic force (the magnetic flux density) running from the magnetic core 84 and intersecting the fixing belt 61 may vary partially on the surface of the fixing belt 61.

To secure the exciting coil 82 to the support 81, adhesive is used in general. Specifically, adhesive is first applied to the inner surface, i.e., a side to be in contact with the support 81, of the exciting coil 82. Alternatively, the adhesive may be applied to the supporting surface 81*a* of the support 81. Subsequently, the exciting coil 82 is positioned along the supporting rails 81*c* of the support 81. The supporting rails 81*c* function as preset attaching references. In this state, the exciting coil 82 is pressed against the supporting surface 81*a*. Thus, the exciting coil 82 is secured to the support 81. The adhesive may be any of popular materials such as silicone-based adhesive. The exciting coil 82 is made of, for example, a Litz wire coiled in a closed loop shape and individual lines of the wire are bonded together. Therefore, the exciting coil 82 tends to deform easily. If the exciting coil 82 deforms, the position accuracy of the exciting coil 82 with respect to the support 81 tends to be reduced. If the position accuracy of the exciting coil 82 with respect to the support 81 is reduced, the amount of heat generation on the surface of the fixing belt 61 may vary partially. Therefore, the exciting coil 82 is pressed uniformly with such a pressure as not to deform the exciting coil 82.

Temperature Sensor

The temperature sensor 100 will now be described in detail.

Figure 9:
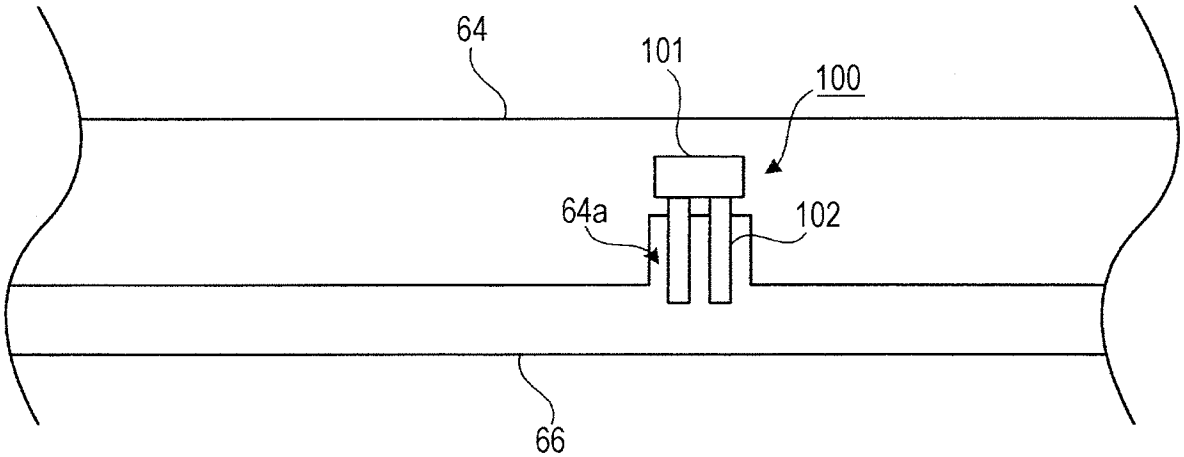
FIG. 9 illustrates a configuration of a temperature sensor and how the temperature sensor is attached to the fixing device.

FIG. 9 illustrates the configuration of the temperature sensor 100 and how the temperature sensor 100 is attached to the fixing unit 60. The temperature sensor 100 illustrated in FIG. 9 is seen in the direction of arrow IX illustrated in FIG. 3.

The temperature sensor 100 illustrated in FIG. 9 is a thermistor temperature sensor and includes a temperature sensing portion 101 having a thermistor whose resistance changes with changes in the temperature, and a supporting portion 102 at which the temperature sensor 100 is attached to the fixing unit 60.

Examples of the thermistor used as the temperature sensing portion 101 include a negative-temperature-coefficient (NTC) thermistor whose resistance decreases with the rise of temperature, a positive-temperature-coefficient (PTC) thermistor whose resistance increases with the rise of temperature, and a critical-temperature-resistor (CTR) thermistor whose resistance decreases with the rise of temperature and whose sensitivity increases in a specific range of temperature. Among these thermistors, the NTC thermistor, in which changes in the temperature and in the resistance are proportional to each other, is suitable for temperature detection. The NTC thermistor may be, for example, a sintered body obtained by sintering a mixture of oxides such as nickel, manganese, cobalt, iron, and the like.

The supporting portion 102 includes flexible plate-like elastic members. The temperature sensing portion 101 is pressed by the supporting portion 102, whereby a state of contact between the temperature sensing portion 101 and the inner circumferential surface of the fixing belt 61 is maintained, so that the temperature of the fixing belt 61 is measurable. The supporting portion 102 may be made of, for example, a heat-resistant resin film. The supporting portion 102 includes thereinside two pieces of lead wire (not illustrated) that are connected to the temperature sensing portion 101. The two pieces of lead wire are connected to each other via the temperature sensing portion 101. The resistance of the temperature sensing portion 101 is monitored while an electric current is supplied to the two pieces of lead wire, whereby the temperature of the fixing belt 61 is measured.

The temperature-sensitive magnetic member 64 has a cut portion 64*a*, in which the temperature sensor 100 is provided. Since the temperature sensor 100 is provided in the cut portion 64*a*, the temperature sensing portion 101 of the temperature sensor 100 is made to be in contact with the inner circumferential surface of the fixing belt 61.

Relationship Between Cut Portion and Temperature Distribution of Fixing Belt in Scanning Direction In a case where the temperature-sensitive magnetic member 64 has the cut portion 64*a*, the cut portion 64*a* has a different amount of heat generation and a different heat capacity from those of the other portion of the temperature-sensitive magnetic member 64. If any segments of the magnetic core 84 are present on the magnetic circuit that intersects the cut portion 64*a*, the temperature of the fixing belt 61 rises at a position corresponding to the cut portion 64*a*. This is because of the following reason. Since the heat capacity of the temperature-sensitive magnetic member 64 is reduced at the cut portion 64*a*, the temperature at the cut portion 64*a* of the temperature-sensitive magnetic member 64 tends to become high. If unfixed toner images are fixed on the paper P in such a state, the gloss of the resultant image may become nonuniform and/or the degree of fixing may become nonuniform.

Figure 10A:
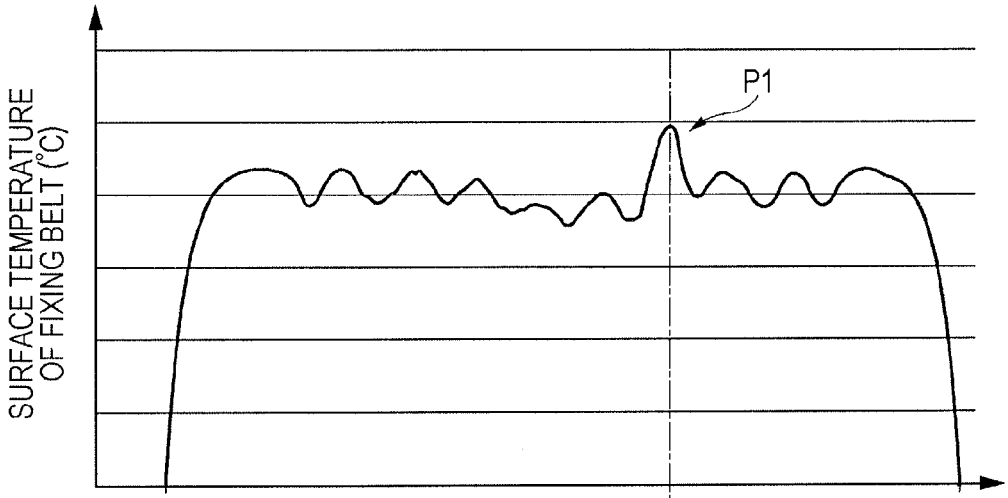
FIGS. 10A to 10C illustrate a positional relationship between a cut portion of a temperature-sensitive magnetic member and segments of a magnetic core and a temperature distribution of the fixing belt in a scanning direction according to a first example.
Figure 10B:
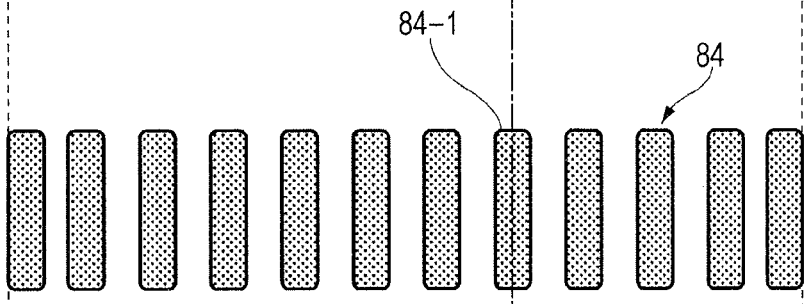
Figure 10C:
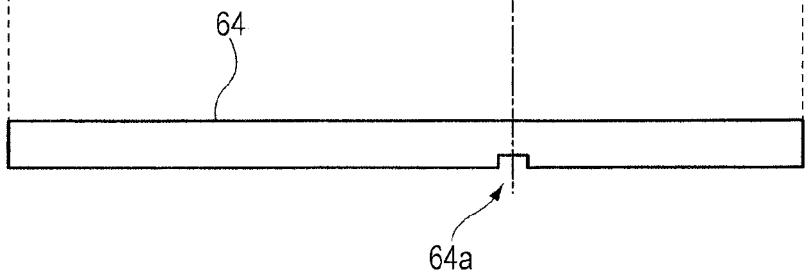

FIGS. 10A to 10C illustrate a positional relationship between the cut portion 64*a* of the temperature-sensitive magnetic member 64 and the segments of the magnetic core 84 and a temperature distribution of the fixing belt 61 in the scanning direction according to a first example. FIG. 10B illustrates the positions of the respective segments of the magnetic core 84 in the scanning direction. FIG. 10C illustrates the position of the cut portion 64*a* of the temperature-sensitive magnetic member 64 in the scanning direction. FIG. 10A is a graph illustrating the temperature distribution of the fixing belt 61 in the scanning direction. In the graph in FIG. 10A, the horizontal axis represents the position in the scanning direction, which corresponds to the positions of the cut portion 64*a* and the segments of the magnetic core 84, and the vertical axis represents the surface temperature of the fixing belt 61.

In the example illustrated in FIG. 10C, the magnetic circuit is produced in the vertical direction. One of the segments of the magnetic core 84 is present on a magnetic circuit intersecting the cut portion 64*a*. In FIG. 10B, the one segment of the magnetic core 84 is denoted by 84-1. In this case, as illustrated in FIG. 10A, a peak P1 representing a high temperature of the fixing belt 61 appears at a position corresponding to the cut portion 64*a*.

In the exemplary embodiment, such a situation is avoided by not providing any segments of the magnetic core 84 at the position corresponding to the cut portion 64*a* in the direction in which the magnetic circuit is produced.

FIGS. 11A to 11C and FIGS. 12A to 12C illustrate a positional relationship between the cut portion 64*a* of the temperature-sensitive magnetic member 64 and the segments of the magnetic core 84 and different temperature distributions of the fixing belt 61 in the scanning direction according to a second example.

Figure 11A:
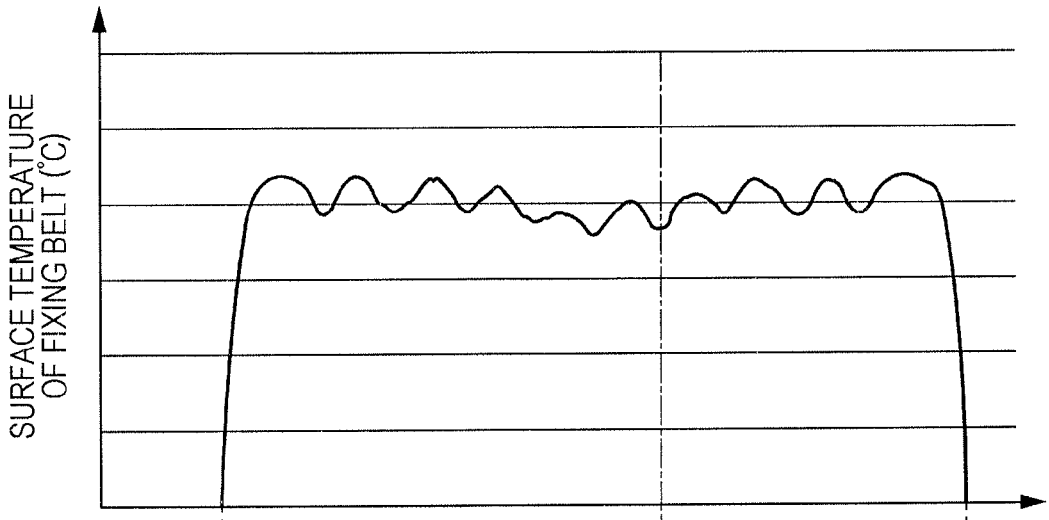
FIGS. 11A to 11C illustrate a positional relationship between the cut portion of the temperature-sensitive magnetic member and the segments of the magnetic core and a temperature distribution of the fixing belt in the scanning direction according to a second example.
Figure 11B:
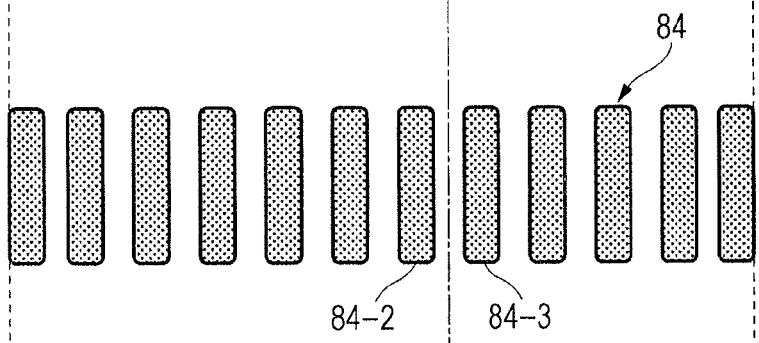
Figure 11C:
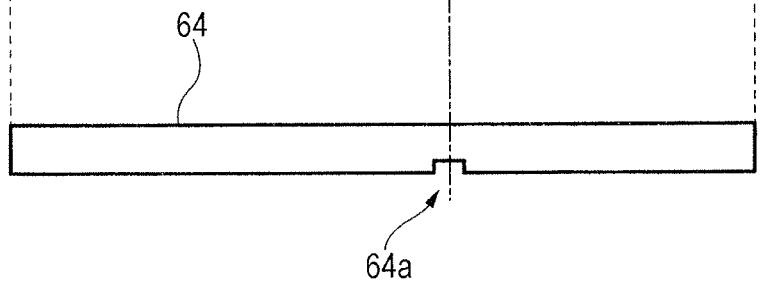
Figure 12A:
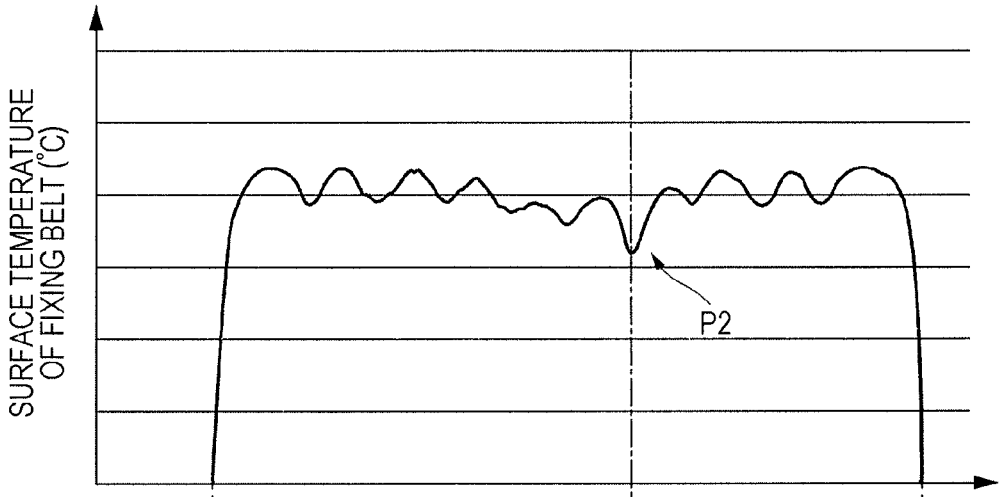
FIGS. 12A to 12C illustrate the positional relationship between the cut portion of the temperature-sensitive magnetic member and the segments of the magnetic core and another temperature distribution of the fixing belt in the scanning direction according to the second example.

As with FIGS. 10B and 10C, FIGS. 11B and 11C and FIGS. 12B and 12C illustrate the positions of the segments of the magnetic core 84 and the position of the cut portion 64*a* in the scanning direction. As with FIG. 10A, FIGS. 11A and 12A are graphs each illustrating the temperature distribution of the fixing belt 61 in the scanning direction. Specifically, the graph in FIG. 11A illustrates the temperature distribution of the fixing belt 61 immediately after the warm-up operation performed by the fixing unit 60, and the graph in FIG. 12A illustrates the temperature distribution of the fixing belt 61 during the fixing operation performed by the fixing unit 60.

In the exemplary cases illustrated in FIGS. 11B and 11C and FIGS. 12B and 12C, no segments of the magnetic core 84 are present on the extension of the center line of the cut portion 64*a* in the direction in which the magnetic circuit is produced. That is, in these exemplary cases, two of the segments of the magnetic core 84, i.e., segments 84-2 and 84-3, are provided on both sides of the position corresponding to the cut portion 64*a* in the direction in which the magnetic circuit is produced. Therefore, in the case illustrated in FIG. 11A, the temperature of the fixing belt 61 in the portion of the fixing belt 61 corresponding to the cut portion 64*a* does not become higher than in the other portion of the fixing belt 61. This is because of the following reason. The magnetic flux density is high at the positions corresponding to the segments 84-2 and 84-3 but is relatively low at the position corresponding to the cut portion 64*a*. Therefore, the temperature of the temperature-sensitive magnetic member 64 does not tend to rise.

Referring to FIG. 12A illustrating the temperature distribution of the fixing belt 61 during the fixing operation, a peak P2 that is lower than the other peaks appears at the position corresponding to the cut portion 64*a*. The amount of heat generation from the temperature-sensitive magnetic member 64 itself is small at the cut portion 64*a*. Since the cut portion 64*a* is provided in the temperature-sensitive magnetic member 64, the area of contact between the temperature-sensitive magnetic member 64 and the fixing belt 61 is reduced. Hence, the period of time of contact between the temperature-sensitive magnetic member 64 and the fixing belt 61 is reduced. Accordingly, the amount of heat transferred from the temperature-sensitive magnetic member 64 to the fixing belt 61 is reduced. Consequently, the temperature of the fixing belt 61 drops.

To reduce the probability that the peak P2 may appear in the graph illustrated in FIG. 12A, the interval of the segments of the magnetic core 84 at the position corresponding to the peak P2 may be reduced from the interval at the other positions.

Figure 13:
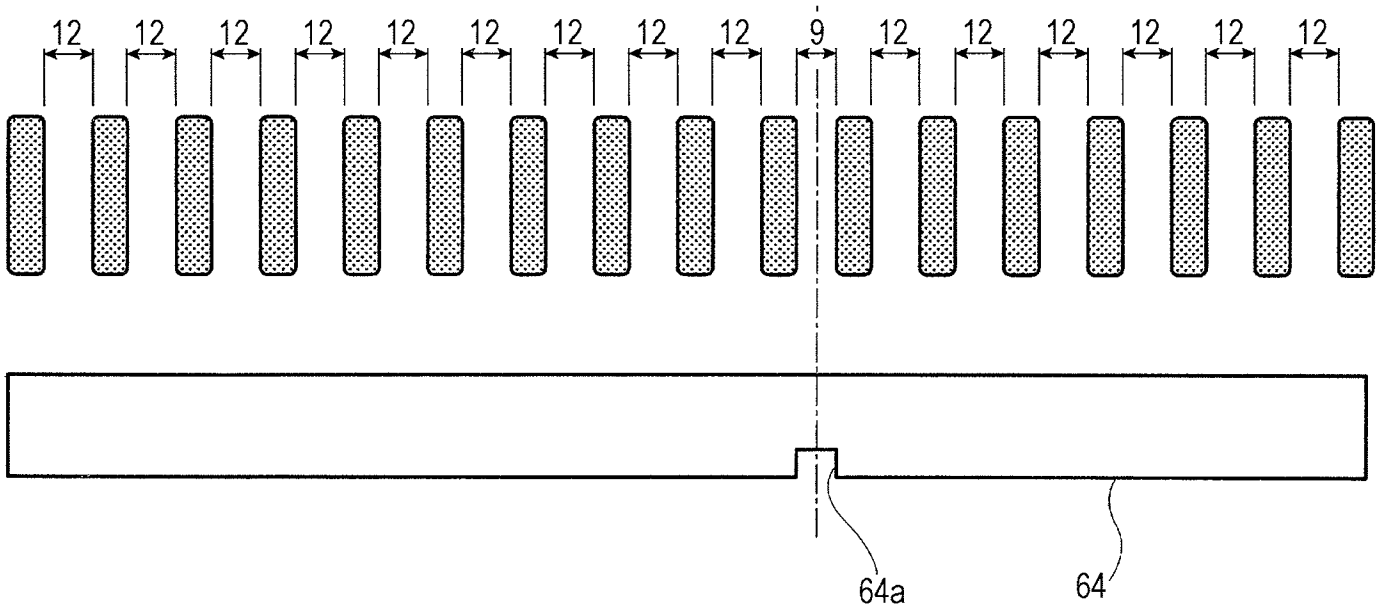
FIG. 13 illustrates the interval of the segments of the magnetic core according to the exemplary embodiment.

FIG. 13 illustrates the interval of the segments of the magnetic core 84 according to the exemplary embodiment.

As illustrated in FIG. 13, the segments of the magnetic core 84 are normally provided at a predetermined first interval of 12 mm, except that the interval of the segments of the magnetic core 84 at the position corresponding to the cut portion 64*a* is set to a second interval of 9 mm, which is smaller than the first interval. That is, the interval of the segments of the magnetic core 84 is smaller at the position corresponding to the cut portion 64*a* than at the other positions. Hence, in the exemplary embodiment, the magnetic core 84 includes, so as to each produce a magnetic circuit, segments that are provided at the first interval and segments that are provided at the second interval smaller than the first interval and on both sides of the extension of the center line of the cut portion 64*a* in the direction in which the magnetic circuit is produced. In other words, some of the segments of the magnetic core 84 are provided at the predetermined first interval in the scanning direction and the other segments of the magnetic core 84 are provided at the second interval that is smaller than the first interval such that the segments at the second interval are provided on both sides of the position corresponding to the cut portion 64*a* of the temperature-sensitive magnetic member 64 in the direction in which the magnetic circuit is produced while the other segments at the first interval are provided at the other positions.

FIGS. 14A to 14C and FIGS. 15A to 15C illustrate a positional relationship between the cut portion 64*a* of the temperature-sensitive magnetic member 64 and the segments of the magnetic core 84 and different temperature distributions of the fixing belt 61 in the scanning direction according to a third example.

FIGS. 14B and 14C and FIGS. 15B and 15C illustrate the positions of the segments of the magnetic core 84 and the position of the cut portion 64*a* in the scanning direction. FIGS. 14A and 15A are graphs each illustrating the temperature distribution of the fixing belt 61 in the scanning direction. Specifically, the graph in FIG. 14A illustrates the temperature distribution of the fixing belt 61 immediately after the warm-up operation performed by the fixing unit 60, and the graph in FIG. 15A illustrates the temperature distribution of the fixing belt 61 during the fixing operation performed by the fixing unit 60.

Figure 12B:
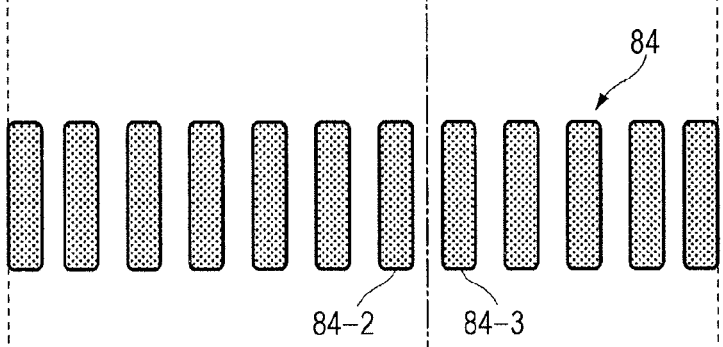
Figure 12C:
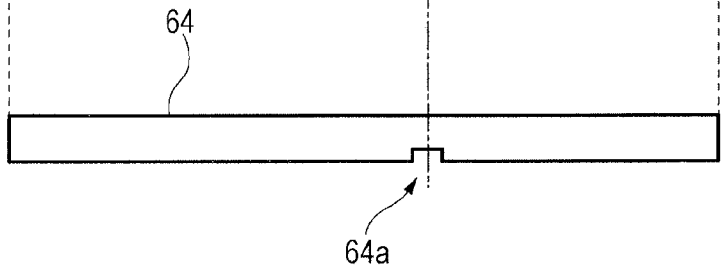

As with the case illustrated in FIGS. 12B and 12C, in the cases illustrated in FIGS. 14B and 14C and FIGS. 15B and 15C, no segments of the magnetic core 84 are present on the extension of the center line of the cut portion 64*a* in the direction in which the magnetic circuit is produced. Two segments of the magnetic core 84 on both sides of the extension of the center line of the cut portion 64*a* are herein denoted by 84-4 and 84-5. Furthermore, in the exemplary embodiment, as illustrated in FIG. 13, the interval of the segments 84-4 and 84-5 of the magnetic core 84 is smaller than the interval of the other segments.

Figures 14A, 14B, 14C:
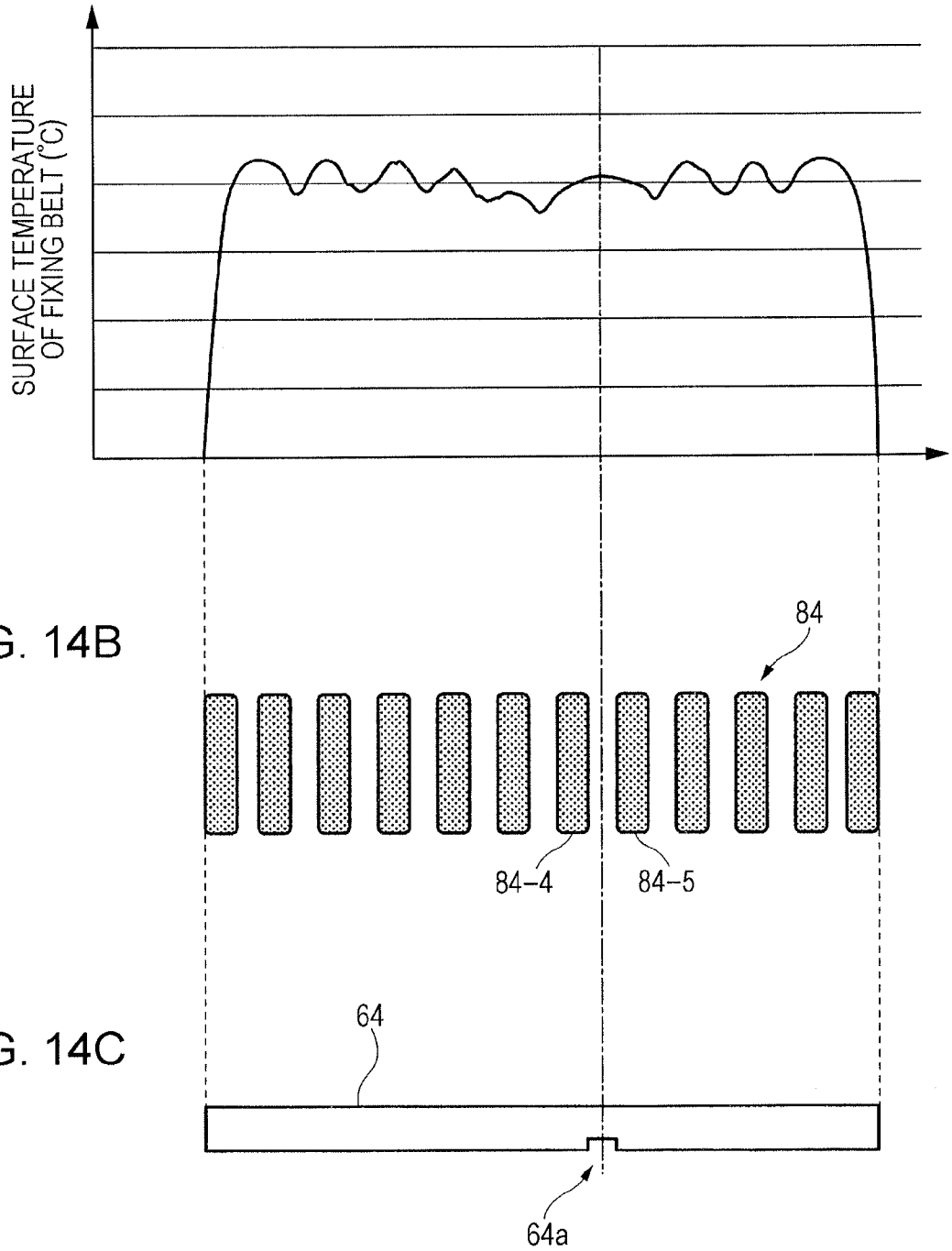
FIGS. 14A to 14C illustrate a positional relationship between the cut portion of the temperature-sensitive magnetic member and the segments of the magnetic core and a temperature distribution of the fixing belt in the scanning direction according to a third example.
Figure 15A:
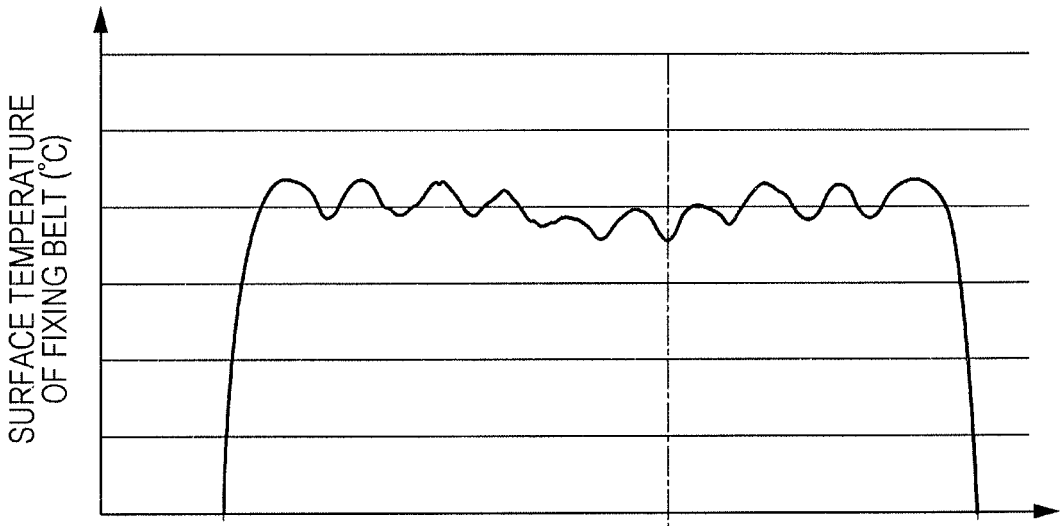
FIGS. 15A to 15C illustrate the positional relationship between the cut portion of the temperature-sensitive magnetic member and the segments of the magnetic core and another temperature distribution of the fixing belt in the scanning direction according to the third example.
Figure 15B:
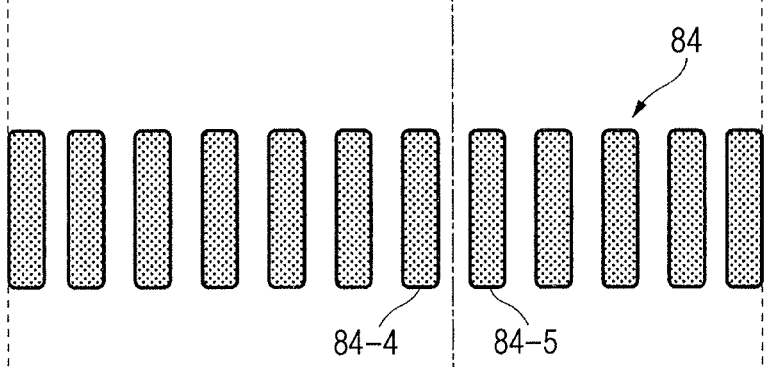
Figure 15C:
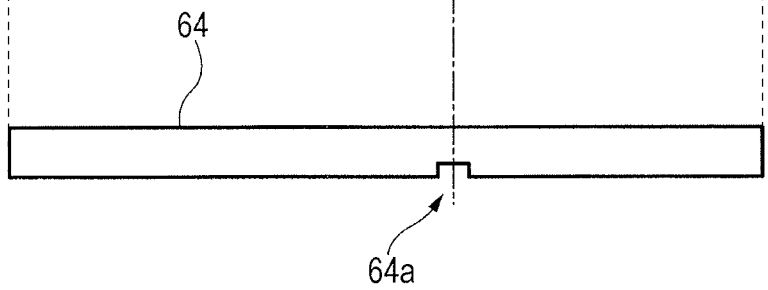

According to this exemplary embodiment, as illustrated in FIGS. 14A and 15A, the temperature of the fixing belt 61 at the position corresponding to the cut portion 64*a* does not become higher than the other positions of the fixing belt 61. Moreover, as illustrated in FIG. 15A, the temperature of the fixing belt 61 during the fixing operation at the position corresponding to the cut portion 64*a* does not become lower than the other positions of the fixing belt 61. Since the interval (the second interval) of the segments of the magnetic core 84 at the position corresponding to the cut portion 64*a* is smaller than the interval (the first interval) of the other segments of the magnetic core 84, the magnetic flux density at the position corresponding to the cut portion 64*a* becomes high and the amount of heat generation from the temperature-sensitive magnetic member 64 increases at the cut portion 64*a*, compensating the reduction in the heat capacity that occurs by providing the cut portion 64*a*. Therefore, the second interval may be determined in accordance with the reduction in the heat capacity of the temperature-sensitive magnetic member 64 that occurs by providing the cut portion 64*a* in the temperature-sensitive magnetic member 64.

In the fixing unit 60 described above, the variation in the temperature of the fixing belt 61 in the scanning direction is reduced. Consequently, the gloss of an image obtained after the fixing operation does not tend to vary, and an image forming apparatus that is capable of forming a good image is provided.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member including a conductive layer and that fixes toner on a recording material while the conductive layer is induction-heated;

a magnetic-field-producing unit including an exciting member that produces an alternating-current magnetic field intersecting the conductive layer of the fixing member, and first magnetic-circuit-producing members that each produce a magnetic circuit of the alternating-current magnetic field produced by the exciting member, the first magnetic-circuit-producing members including members provided at a predetermined first interval in a longitudinal direction of the fixing member and members provided at a second interval in the longitudinal direction of the fixing member, the second interval being smaller than the first interval;

a temperature measuring device provided in contact with an inner circumferential surface of the fixing member and that measures the temperature of the fixing member; and a second magnetic-circuit-producing member having a cut portion in which the temperature measuring device is provided, the second magnetic-circuit-producing member being in contact with the inner circumferential surface of the fixing member and producing a magnetic circuit of the alternating-current magnetic field produced by the magnetic-field-producing unit, the second magnetic-circuit-producing member conducting heat to the fixing member by being induction-heated, wherein the first magnetic-circuit-producing members at the second interval are provided on both sides of a position corresponding to the cut portion of the second magnetic-circuit-producing member in a direction in which the magnetic circuit is produced, and the first magnetic-circuit-producing members at the first interval are provided at other positions.

2. The fixing device according to claim 1, wherein the second interval is determined in accordance with reduction in heat capacity of the second magnetic-circuit-producing member that occurs by providing the cut portion in the second magnetic-circuit-producing member.

3. A fixing device comprising:

a fixing member including a conductive layer and that fixes toner on a recording material while the conductive layer is induction-heated;

a magnetic-field-producing unit including an exciting member that produces an alternating-current magnetic field intersecting the conductive layer of the fixing member, and first magnetic-circuit-producing members that are provided at a predetermined interval in a longitudinal direction of the fixing member and each produce a magnetic circuit of the alternating-current magnetic field produced by the exciting member;

a temperature measuring device provided in contact with an inner circumferential surface of the fixing member and that measures the temperature of the fixing member; and a second magnetic-circuit-producing member having a cut portion in which the temperature measuring device is provided, the second magnetic-circuit-producing member being in contact with the inner circumferential surface of the fixing member and producing a magnetic circuit of the alternating-current magnetic field produced by the magnetic-field-producing unit, the second magnetic-circuit-producing member conducting heat to the fixing member by being induction-heated, wherein the first magnetic-circuit-producing members are provided avoiding an extension of a center line of the cut portion in a direction in which the magnetic circuit is produced.

4. The fixing device according to claim 3, wherein the first magnetic-circuit-producing members include members provided at a first interval; and members provided at a second interval smaller than the first interval and on both sides of the extension of the center line.

5. An image forming apparatus comprising:

a toner-image-forming section that forms a toner image;

a transfer section that transfers the toner image to a recording material; and a fixing section that includes a fixing member including a conductive layer and that fixes toner on a recording material while the conductive layer is induction-heated, a magnetic-field-producing unit including an exciting member that produces an alternating-current magnetic field intersecting the conductive layer of the fixing member, and first magnetic-circuit-producing members that each produce a magnetic circuit of the alternating-current magnetic field produced by the exciting member, the first magnetic-circuit-producing members including members provided at a predetermined first interval in a longitudinal direction of the fixing member and members provided at a second interval in the longitudinal direction of the fixing member, the second interval being smaller than the first interval, a temperature measuring device provided in contact with an inner circumferential surface of the fixing member and that measures the temperature of the fixing member, and a second magnetic-circuit-producing member having a cut portion in which the temperature measuring device is provided, the second magnetic-circuit-producing member being in contact with the inner circumferential surface of the fixing member and producing a magnetic circuit of the alternating-current magnetic field produced by the magnetic-field-producing unit, the second magnetic-circuit-producing member conducting heat to the fixing member by being induction-heated, wherein the first magnetic-circuit-producing members at the second interval are provided on both sides of a position corresponding to the cut portion of the second magnetic-circuit-producing member in a direction in which the magnetic circuit is produced, and the first magnetic-circuit-producing members at the first interval are provided at other positions.

* * * * *